United States Patent [19]

Temburg et al.

[11] Patent Number: 5,033,165

[45] Date of Patent: Jul. 23, 1991

[54] APPARATUS FOR OPENING AND CLEANING FIBER MATERIAL

[75] Inventors: Konrad Temburg, Mönchen-Gladbach; Ferdinand Leifeld, Kempen; Stefan Schlichter, Mönchen-Gladbach, all of Fed. Rep. of Germany

[73] Assignee: Trützschler GmbH & Co. KG, Mönchen-Gladbach, Fed. Rep. of Germany

[21] Appl. No.: 387,993

[22] Filed: Aug. 1, 1989

[30] Foreign Application Priority Data

Aug. 2, 1988 [DE] Fed. Rep. of Germany ..... 3826202
Mar. 2, 1989 [DE] Fed. Rep. of Germany ..... 3906640

[51] Int. Cl.[5] ..... D01G 9/06; D01G 15/40
[52] U.S. Cl. ..... 19/107; 19/200
[58] Field of Search ..... 19/107, 105, 200, 205, 19/207

[56] References Cited

U.S. PATENT DOCUMENTS

| | | | |
|---|---|---|---|
| 2,589,008 | 3/1952 | Lannan . | |
| 4,126,914 | 11/1978 | Winch et al. | 19/99 |
| 4,512,060 | 4/1985 | Shofner | 19/200 |
| 4,519,114 | 5/1985 | Rhyne | 19/200 |
| 4,524,492 | 6/1985 | Elliott | 19/107 |
| 4,625,368 | 12/1986 | Leifeld | 19/200 |
| 4,637,096 | 1/1987 | Wise et al. | 19/200 |
| 4,694,538 | 9/1987 | Pinto et al. | 19/105 |
| 4,797,980 | 1/1989 | Jagst | 19/107 |
| 4,858,277 | 8/1989 | Pinto et al. | 19/200 |
| 4,866,815 | 9/1989 | Lucassen et al. | 19/205 |

FOREIGN PATENT DOCUMENTS

| | | |
|---|---|---|
| 6970 | 3/1979 | European Pat. Off. . |
| 2660497 | 7/1982 | Fed. Rep. of Germany . |
| 8610940 | 10/1987 | Fed. Rep. of Germany . |
| 2939861 | 3/1988 | Fed. Rep. of Germany . |
| 8705138 | 9/1988 | Fed. Rep. of Germany . |
| 245226 | 1/1926 | United Kingdom . |
| 849548 | 9/1960 | United Kingdom . |
| 992335 | 5/1965 | United Kingdom . |
| 1482863 | 8/1977 | United Kingdom . |
| 2043725 | 10/1980 | United Kingdom . |
| 1591806 | 6/1981 | United Kingdom . |
| 2182956 | 5/1987 | United Kingdom . |

*Primary Examiner*—Werner H. Schroeder
*Assistant Examiner*—John J. Calvert
*Attorney, Agent, or Firm*—Spencer & Frank

[57] ABSTRACT

An apparatus for opening and cleaning textile fiber material includes a fiber feeding device for advancing the fiber material; a first clothed roller situated downstream of the fiber feeding device and being arranged for entraining the fiber material advanced by the fiber feeding device; a second clothed roller situated downstream of the first clothed roller and being arranged for entraining fiber material after entrainment thereof by the first clothed roller; a mote knife cooperating with the first and second clothed roller; a waste removal clearance bounded by each respective mote knife; and a third clothed roller situated between the first and second clothed rollers. The first, third and second clothed rollers are arranged in series, whereby the fiber material passes from the first clothed roller to the third clothed roller and from the third clothed roller to the second clothed roller. The third clothed roller cooperates with the first clothed roller and the second clothed roller cooperates with the third clothed roller as a doffer-and-opening roller.

10 Claims, 4 Drawing Sheets

APPARATUS FOR OPENING AND CLEANING FIBER MATERIAL

CROSS REFERENCE TO RELATED APPLICATION

This application claims the priority of Federal Republic of Germany Application No. P 38 26 202.9 filed Aug. 2, 1988, which is incorporated herein by reference.

BACKGROUND OF THE INVENTION

This invention relates to an apparatus for opening and cleaning fiber material, particularly cotton and is of the type which has at least two rollers provided with a clothing (hereafter "clothed rollers") arranged downstream of a fiber feeding device, as viewed in a direction of fiber feed. At least two of the clothed rollers are provided with a mote knife associated with a waste removal clearance. The centrifugal forces at the circumference of the second clothed roller are greater than at the circumference of the first clothed roller arranged upstream of the second clothed roller as viewed in the direction of the advance of the fiber material.

In a known apparatus of the above-outlined type, as disclosed, for example, in German Offenlegungsschrift (non-examined published application) No. 2,712,650, first and second clothed rollers are serially arranged and are rotated in opposite directions. The second clothed roller has a smaller diameter and rotates with a significantly higher rpm than the first clothed roller and the points of the two clothings are in a fiber-transferring (doffing) position relative to one another. The vacuum present in a downstream-arranged screen drum extends back to the second clothed roller via a fiber conveying channel. After passing the waste removal clearance, the fiber material leaves the second clothed roller and is admitted to the screen drum. This occurrence is influenced by an intake air stream which passes through an opening in the housing and the waste removal clearance. According to another embodiment disclosed in the above-identified German Offenlegungsschrift, the first and second clothed rollers are associated with a third clothed roller which has the same diameter as the first clothed roller and which rotates codirectionally therewith but has a lower rpm. The clothing points of the first and the third clothed rollers are in a carding relationship with one another. The third clothed roller is surrounded by a housing interrupted by a waste removal clearance provided with a mote knife. In both embodiments the second clothed roller cooperates directly with the first clothed roller.

It has been found that in a prior art arrangement as described above, the suction air stream which takes off the fiber material from the second clothed roller has, disadvantageously, a feedback effect on the first clothed roller. It is particularly disadvantageous that the suction stream gains access to the region about the first clothed roller by extending through the intermediate space between the first clothed roller and the housing and thus adversely affects the guidance of the fiber. It is furthermore disadvantageous that by virtue of the intake air stream which is admitted from the outside, the suction air stream, together with the useful fiber tufts removed from the second clothed roller, also entrains trash from the waste removal clearance associated with the second clothed roller. The suction stream provided to advance the fiber material to the screen drum has a disadvantageous effect on the waste removal clearances associated with the first and second clothed rollers. It is yet another disadvantage of the above-described prior art construction that the fiber material, upon direct transfer from the first to the second clothed roller can be opened only as a result of particularly high rpm's which requires a structurally complex arrangement, and further, the rpm is limited by the critical bending rpm and the width of the clothed roller. Since the fiber material is insufficiently opened because of the significantly lower rpm's, the cleaning effect of the second clothed roller is altogether insufficient.

SUMMARY OF THE INVENTION

It is an object of the invention to provide an improved apparatus of the above-outlined type from which the discussed disadvantages are eliminated and which, in particular, ensures a more uniform fiber guidance and an improved cleaning of the fiber material.

This object and others to become apparent as the specification progresses, are accomplished by the invention, according to which, briefly stated, between the first and the second clothed roller there is arranged a third clothed roller and further, the three clothed rollers are arranged in a series. The third clothed roller cooperates with the first clothed roller and the second clothed roller cooperates with the third clothed roller to function simultaneoulsy as a transfer (doffer) roller and as an opening roller.

By virtue of providing a third clothed roller between the first and second clothed rollers, the first and second clothed rollers are spatially separated from one another. It is of importance that the three clothed rollers are arranged in series with one another, that is, the second clothed roller directly cooperates only with the third clothed roller and not with the first clothed roller. In this manner, the second clothed roller cooperates only with the third clothed roller and the third clothed roller cooperates only with the first clothed roller as a doffer and opening roller. The spatial distance between the second and the first clothed roller, by virtue of the insertion of the third clothed roller (intermediate roller), has the advantage that aerodynamic disturbances of prior art constructions are avoided. By virtue of the fact that the third clothed roller cooperates as a takeover (doffer) roller and opening roller with the first clothed roller, that is, the clothing points of the first and third rollers are not in a carding relationship with one another, yields the further advantage that the fiber material is additionally opened and drawn (stretched) so that the cleaning effect carried out by the second clothed roller is improved. The third clothed roller (intermediate roller) thus has a dual advantage, that is, it prevents the air streams from having a disturbing effect on the first clothed roller and it improves the opening of the fiber material so that, as a final result, a more uniform fiber material guidance and an improved cleaning of the fiber material are achieved. A further improvement of the fiber stream is achieved by the fact that by virtue of the additional drawing (stretching) on the third clothed roller the fiber distribution on the second clothed roller is rendered more uniform: non-uniform areas in the fiber mat are drawn (pulled apart) by the second clothed roller.

The greater the distance between the waste removal clearances for the first and second clothed rollers, the better the separation of the air guidance in the zone of the locations of waste separation. As a result, consecutive waste removal clearances have no mutual effect on one another; the suction stream for the fiber material and the stream of the removed impurities are separated from one another. The waste separating and fly chambers too, are at a substantial distance from one another in the zones underneath the two waste removal clearances. Each waste removal clearance generates, in the zones immediately therebelow, turbulences and for the separation of the waste from the turbulent flows large quieting spaces are needed. These too, are designed to be larger and are at a greater distance from one another. This arrangement ensures that the waste stream exiting through the waste removal clearance associated with the second clothed roller has a more difficult access to the waste removal clearance of the first clothed roller and to the suction zones which are present at each waste removal clearance.

The invention has the following further advantageous features:

The direction of rotation of the third clothed roller is opposite to that of the first and second clothed rollers. By virtue of the fact that the material flow towards the second clothed roller passes over the third clothed roller, the air flow separation is further strengthened between the waste removal clearances associated with the first and second clothed rollers. Thus, the two waste removal gaps are isolated (decoupled) from one another in a optimal manner.

The third clothed roller is surrounded by a housing which has no waste removal gaps and mote knives.

The peripheral velocity of the third clothed roller is greater than that of the first clothed roller. As a result, the fiber material is additionally opened (stretched) whereby the subsequent cleaning on the second clothed roller is improved.

The peripheral velocity of the second clothed roller is greater than that of the third clothed roller. The peripheral velocity at the second clothed roller is, by virtue of the insertion of the third clothed roller, less than in prior art constructions whereby structural advantages are achieved.

Downstream of the second clothed roller there is arranged a device which separates the fibers from the conveying air stream, such as a screen drum, a dust removing machine or the like to which the fiber material is admitted by an air stream through a conveying duct.

Downstream of the second clothed roller a fiber conveying duct with a conveyor fan is arranged.

In the vicinity of the fiber transfer location of the second clothed roller an air intake slot is provided. This brings about an air intake of transporting air at a distance from the mote knife and the waste removal gap of the second clothed roller to prevent the waste that has passed through the waste removal clearance from being drawn back into the air/fiber stream. The air stream for the fiber material is separated from the waste flow so that no waste is drawn in with the fiber tufts. Expediently, the impurities are removed by centrifugal forces and by gravity.

The diameter of the second clothed roller and the third clothed roller are substantially of identical length, whereby the critical bending rpm of the second clothed roller is improved.

The common cover above the second and third clothed rollers is movable as a unit away from and towards the clothed rollers. In this manner, the placing of the cover into its closed position is simplified and the accessibility to the clothed rollers is improved.

According to a preferred embodiment of the invention, to the opening and cleaning apparatus there is connected, upstream thereof, a fiber feeding device which has an upper, reserve (standby) chute and a lower, feed chute from which the fiber material is admitted to the feeding device by a fiber transfer device.

DESCRIPTION OF THE PREFERRED EMBODIMENTS

Figure 1:
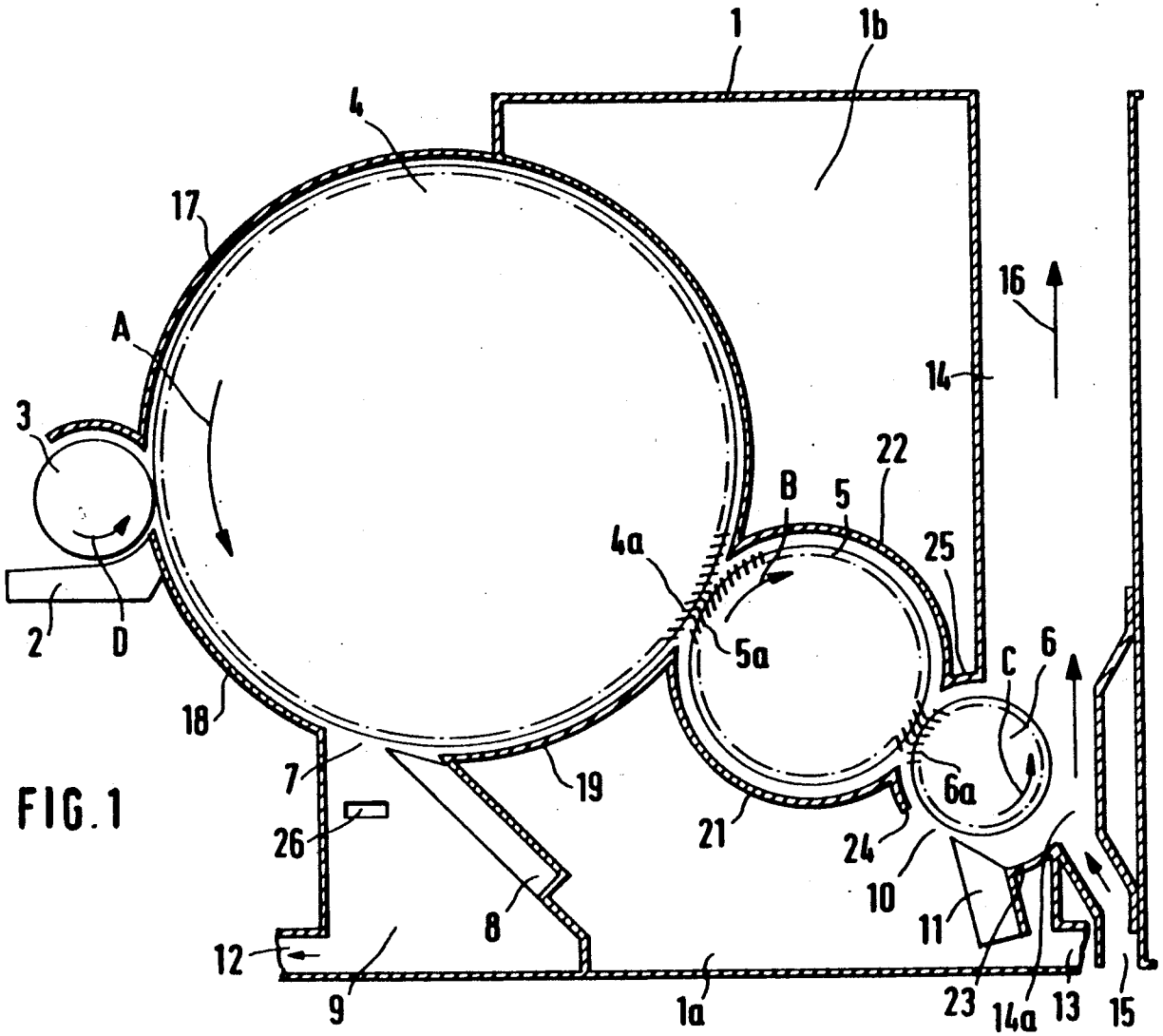
FIGS. 1, 2, 3 and 4 are each schematic side elevational views of four different preferred embodiments of the invention.

Turning to FIG. 1, the opening and cleaning device illustrated therein is accommodated in a housing 1. The fiber material to be cleaned, particularly cotton, is fed as fiber tufts forming a fiber lap to the cleaning and opening device by a feed chute (not shown in FIG. 1). The fiber lap which, by virtue of the pinching cooperation between a feed table 2 and a feed roller 3 (rotating in direction D) is advanced to a first clothed roller 4 rotatably supported in the housing 1 and rotated counterclockwise as indicated by the arrow A. As viewed in the general direction of fiber advance, downstream of the first clothed roller 4 there is arranged a third clothed roller 5 and, thereafter, a second clothed roller 6 which has a smaller diameter than the first and third clothed rollers. The clothing of each roller 4, 5 and 6 is of sawtooth structure. The clothed roller 4 may have a diameter in the range of approximately 360 to 460 mm, for example, 410 mm and a peripheral velocity of approximately 15–21 m/sec, for example, 18 m/sec. The clothed roller 5 may have a diameter in the range of approximately 135–215 mm, for example, 175 mm and a peripheral velocity in the range of approximately 19–25 m/sec, for example, 22 m/sec. Lastly, the clothed roller 6 may have a diameter in the range of approximately 70–130 mm, for example, 100 mm and a peripheral velocity in the range of approximately 23–30 m/sec, for example, 26.5 m/sec.

The clothed rollers 4, 5 and 6 are surrounded by the housing parts 17–25 of the housing 1. Thus, the clothed roller 4 is situated in a closed housing which has a waste removal opening 7 for the fiber impurities. The width of the waste removal opening or clearance 7 is adapted to the respective trash-separating stage. For this purpose, the waste removal gap 7 is bounded by a separating edge (such as a mote knife) 8 which expediently is adjustable and is mounted on the housing part 1*a*. The waste removal clearance 7 is exposed to the effect of an air flow entering the device through an air inlet opening 26 provided in the housing 1.

The second clothed roller 6 rotates with a greater rpm than the other two clothed rollers; its clothing points 6*a* are in a fiber transfer (doffing) relationship with the clothing points 5*a* of the third clothed roller 5. Thus, the second clothed roller 6, based on its effect on the fiber material, may be characterized as a doffer-and-opening roller. The clothing points 5*a* of the clothed roller 5 are in a doffing relationship with the clothing points 4*a* of the first clothed roller 4. If, for example, the ratio of the diameter of the clothed roller 4 to the clothed roller 5 and the ratio of the diameter of the clothed roller 5 to the clothed roller 6 are 2:1 each, then there is obtained at the clothed roller 6, which rotates at a significantly higher rpm than the clothed roller 4, a greater acceleration and thus a greater centrifugal force because of the higher angular velocities than at the first clothed roller 4. The centrifugal forces to which the fiber material is subjected thus increase from roller to roller in the downstream direction. It is thus an advantage of the third clothed roller 5 that the fiber material is accelerated from the first clothed roller 4 to the second clothed roller 6 by means of an intermediate stage; that is, there is ensured a gentle, rather than an abrupt acceleration as the fiber passes from roller to roller. Thus, the third clothed roller 5 essentially performs the function of a transfer roller for supplying fiber from the first clothed roller 4 to the second clothed roller 6. Accordingly, the housing parts (housing covers) 21, 22 entirely and without interruption surround the third clothed roller 5 between the first and second clothed rollers 4, 6 and thus no waste removal opening, mote knife or other fiber processing arrangement (such as stationary carding elements) is associated with the third clothed roller 5. The clothed roller 6 may be connected to a non-illustrated screen drum by means of a fiber conveying duct 14 through which the fiber material is pneumatically conveyed by the air stream 16. The screen drum is, for generating a vacuum at its inside, connected to a suction device (not shown). The vacuum extends through the fiber conveying duct 14 to the clothed roller 6.

In the description which follows, the operation of the above-described opening and cleaning apparatus will be set forth.

The fiber lap formed of fiber tufts is advanced by the feed roller 3— as it clampingly cooperates with the feed table 2— to the first clothed roller 4 which combs the fiber material and entrains fiber bundles on its clothing. As the surface of the clothed roller 4 passes by the waste removal gap 7 provided with the mote knife 8, short fibers and coarse impurities are thrown out of the fiber material through the gap 7 by centrifugal forces which are generated as a function of the circumferential velocity and curvature of the curved roller 4. The trash is collected in a waste chamber 9 in the housing 1.

The fiber material pre-cleaned in this manner is, by means of the clothing points of the third clothed roller 5, taken off the first clothed roller 4 while, at the same time, the fiber material is further opened. Thereafter, the fiber material is, by the clothing points of the second clothed roller 6, taken off the third clothed roller 5 whereby an additional opening is effected and the fiber material is carried past the waste removal gap 10 having the mote knife 11. Since, at the second clothed roller 6 the centrifugal force—as explained earlier—is greater than at the first clothed roller 4, the finer impurities and dust particles are separated from the fiber material at the waste removal clearance 10. By virtue of the opening of the fiber material into individual fibers or at least into very fine fiber tufts by means of the clothed roller 6, the separation of these fiber impurities from the fiber material is enhanced. This may be performed continuously or discontinuously.

After passing the waste removal clearance 10, the fiber material, under the effect of the air flow admitted through the intake slot 15 as well as the centrifugal force, leaves the second clothed roller 6 and is admitted into the fiber duct 14 to thus further proceed to an additional processing appartus, such as a screen drum. The fine and finest impurities such as dust and fiber fragments pass through the perforated jacket of the rotating screen drum and are removed by the suction stream, while the fibers are deposited on the surface of the screen drum and form a fiber mat thereon which, in turn, is removed from the screen drum and is conveyed for further processing.

Figure 2:
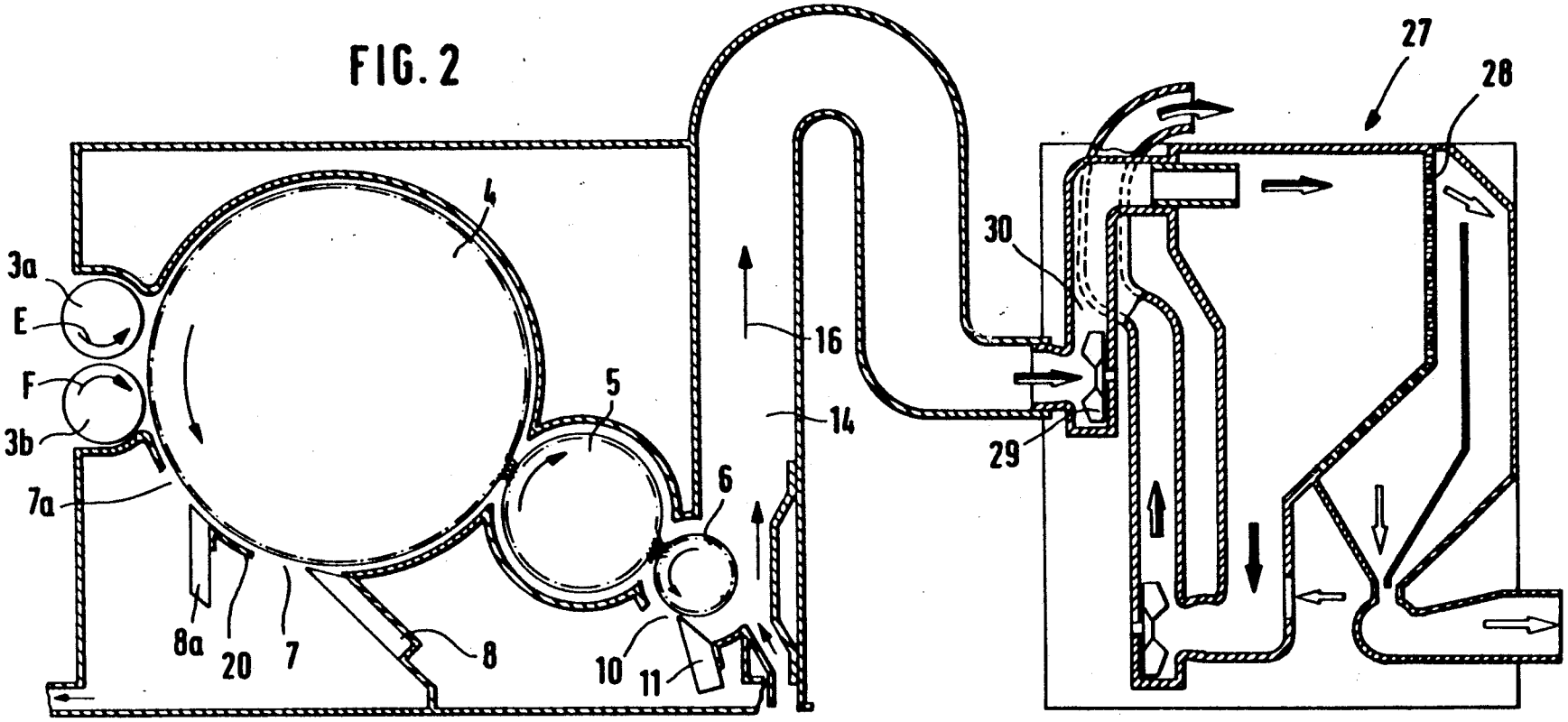

Turning now to the embodiment illustrated in FIG. 2, the fiber lap is fed to the first clothed roller 4 by means of two cooperating feed rollers **3*a*, 3*b* which rotate as indicated by the arrows E and F. Underneath the clothed roller 4 there are provided two waste removal openings 7 and 7*a* bounded by respective mote knives 8 and 8*a*. In addition to the waste removal opening 10 and associated mote knife 11, the second clothed roller 6 may be provided with a further waste removal opening and bounding mote knife (neither shown). The clothed roller 6 is connected by a fiber conveying duct 14 to a dust-removing machine 27 which may be a DUSTEX DX model, manufactured by Trützschler GmbH & Co. KG, Mönchengladbach, Federal Republic of Germany. The fiber conveying duct 14 merges into the intake side of a conveying fan 29 and to the pressure side thereof a fiber conveying duct 30 is connected. The fiber material is separated from the dust-laden air by a stationary screening surface 28**.

Figure 3:
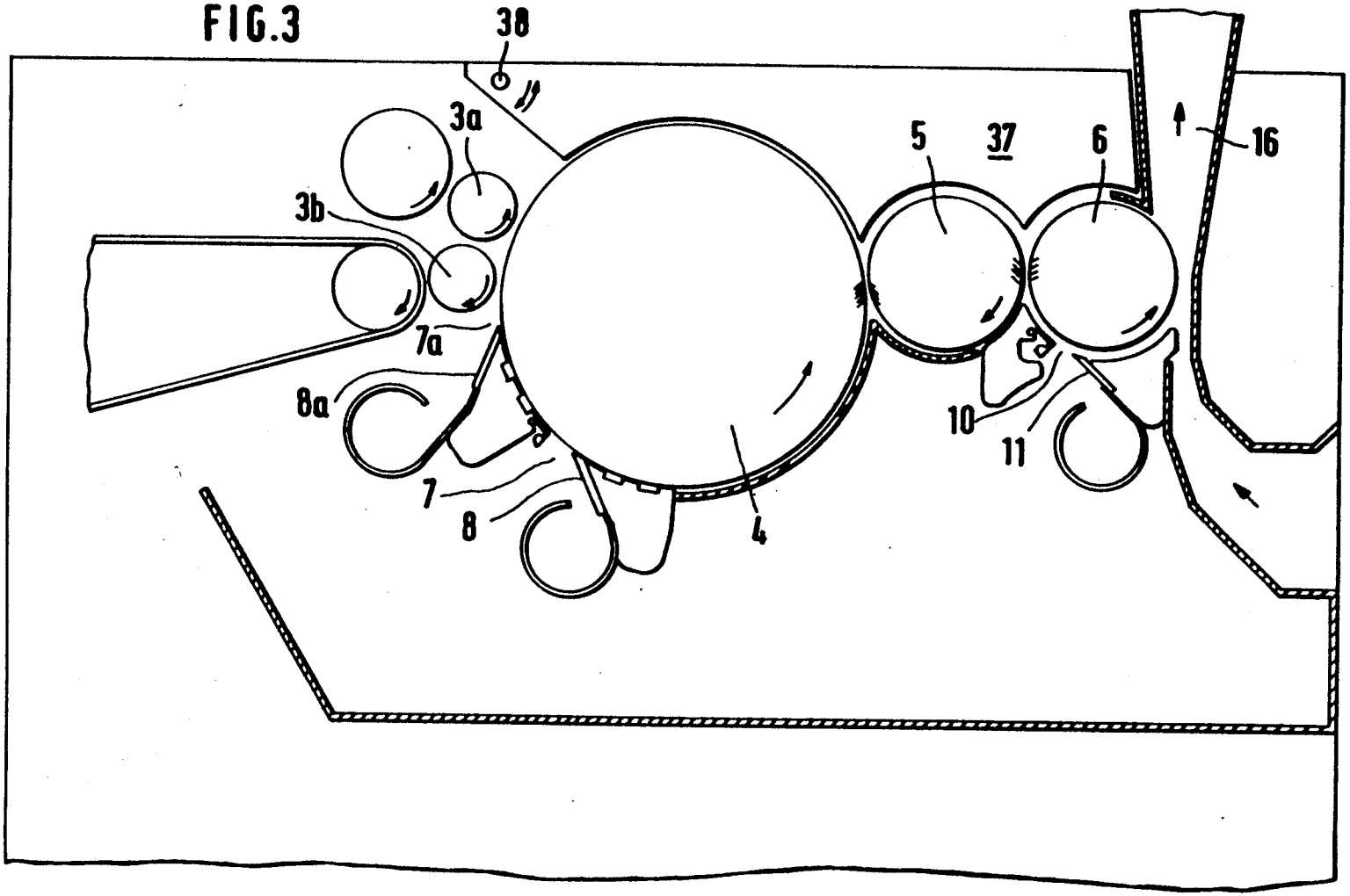

In the embodiment according to FIG. 3, the diameter of the second clothed roller 6 and that of the third clothed roller 5 are of identical magnitude. The centrifugal force on the second clothed roller 6 is greater than that on the first clothed roller 4, and the circumferential velocity at the second clothed roller 6 is greater than that at the third clothed roller 5. The common cover 37 extending above the first, second and third clothed rollers 4, 6 and 5 is supported in the pivotal bearing 38 and is, as a unit, swingable into an open and closed position away from and towards the clothed rollers.

Figure 4:
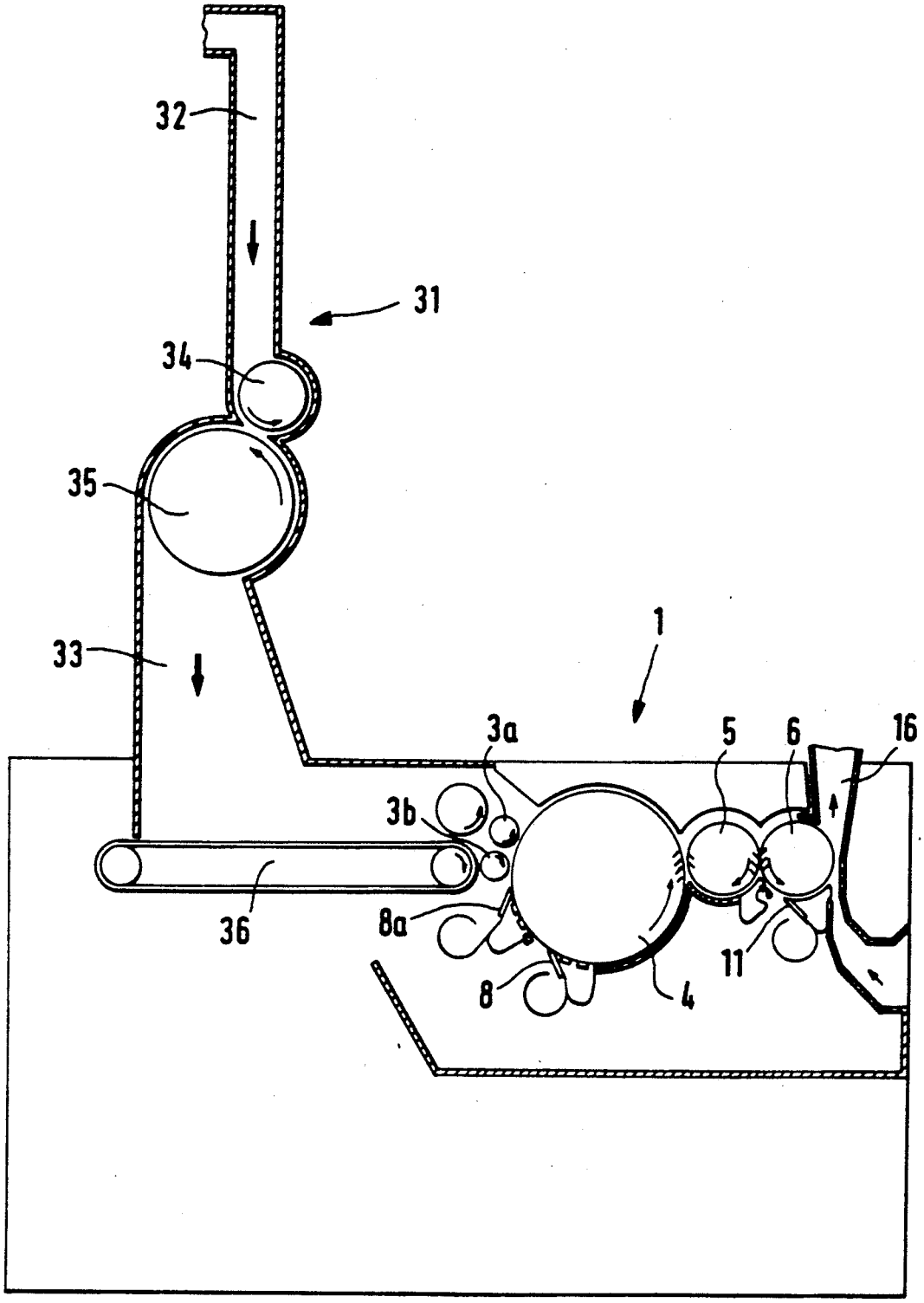

In the embodiment illustrated in FIG. 4, the opening and cleaning apparatus disposed in the housing 1 is preceded by a fiber feeding apparatus 31 which has an upper, reserve chute 32 and a lower, feed chute 33. Between the reserve chute 32 and the feed chute 33 there is provided a slowly rotating intake roller 34 and a rapidly rotating opening roller 35. From the lower end of the feed chute 33 the fiber material is admitted to the feed rollers **3*a*, 3*b* of the cleaning device by a transfer device 36**, such a conveyor belt.

It will be understood that the above description of the present invention is susceptible to various modifications, changes and adaptations, and the same are intended to be comprehended within the meaning and range of equivalents of the appended claims.

What is claimed is:

1. In an apparatus for opening and cleaning textile fiber material including a fiber feeding means for advancing the fiber material in a feeding direction;

a first clothed roller situated downstream of said fiber feeding means as viewed in said feeding direction; said first clothed roller being arranged for entraining the fiber material advanced by said fiber feeding means;

a second clothed roller situated downstream of said first clothed roller and being arranged for entraining fiber material after entrainment thereof by said first clothed roller;

mote knives cooperating with said first and second clothed roller; and means defining waste removal clearances, each bounded by a respective mote knife;

the improvement comprising a third clothed roller situated between said first and second clothed rollers; said first, third and second clothed rollers being arranged in series, whereby the fiber material passes from the first clothed roller to the third clothed roller and from the third clothed roller to the second clothed roller; said first, second and third clothed rollers having clothing points; the clothing points of said first and third rollers and the clothing points of said third and second rollers being in a non-carding, doffing relationship with one another, whereby said third clothed roller cooperates with said first clothed roller and said second clothed roller cooperates with said third clothed roller as a doffer-and-opening roller; further comprising a housing part or cover substantially entirely surrounding said third clothed roller in zones between said first and second clothed rollers; said third clothed roller being void of a waste removal clearance, mote knife and carding arrangement; a fiber conveyor duct extending from said second clothed roller; air stream generating means communicating with said fiber conveyor duct for removing fiber material from said second roller and for advancing the fiber material in the duct from said second clothed roller; and further wherein during operation the circumferential velocity of the third clothed roller is greater than that of said first clothed roller and the circumferential velocity of the second clothed roller is greater than that of the third clothed roller.

2. An apparatus as defined in claim 1, wherein said third clothed roller has a direction of rotation opposite to the direction of rotation of said first and second clothed rollers.

3. An apparatus as defined in claim 1, further comprising fiber separating means connected to said duct for separating the fiber material from the air stream.

4. An apparatus as defined in claim 3, wherein said air stream generating means comprises a fan disposed in said duct.

5. An apparatus as defined in claim 3, wherein said fiber separating means comprises a dust-removing machine.

6. An apparatus as defined in claim 1, wherein said second and third clothed rollers have substantially identical diameters.

7. An apparatus as defined in claim 1, wherein said fiber feeding means comprises an upper, reserve chute and a lower, feed chute extending from the reserve chute, an advancing mechanism to supply the fiber material directly to said first clothed roller and a transfer mechanism conveying the fiber material from the feed chute to said advancing mechanism.

8. An apparatus as defined in claim 7, wherein said fiber feeding means further comprises an intake roller and an opening roller arranged between a downstream end of said reserve chute and an upstream end of said feed chute.

9. In an apparatus for opening and cleaning textile fiber material including a fiber feeding means for advancing the fiber material in a feeding direction;

a first clothed roller situated downstream of said fiber feeding means as viewed in said feeding direction; said first clothed roller being arranged for entraining the fiber material advanced by said fiber feeding means;

a second clothed roller situated downstream of said first clothed roller and being arranged for entraining fiber material after entrainment thereof by said first clothed roller;

mote knives cooperating with said first and second clothed roller; and means defining waste removal clearances, each bounded by a respective mote knife;

the improvement comprising a third clothed roller situated between said first and second clothed rollers; said first, third and second clothed rollers being arranged in series, whereby the fiber material passes from the first clothed roller to the third clothed roller and from the third clothed roller to the second clothed roller; said third clothed roller cooperating with said first clothed roller and said second clothed roller cooperating with said third clothed roller as a doffer-and-opening roller; further comprising a common cover extending over said second and third clothed rollers; said common cover including a part substantially entirely surrounding said third clothed roller in zones between said first and second clothed rollers; said third clothed roller being void of a waste removal clearance, mote knife and carding arrangement; said common cover being movable towards and away from said second and third clothed rollers to assume a respective closed and open position.

10. An apparatus as defined in claim 9, further comprising a fiber conveyor duct extending from said second clothed roller; air stream generating means communicating with the duct for advancing the fiber material therein from said second clothed roller; and means defining an air intake slot situated adjacent said second clothed roller and an upstream end of said duct; said air intake slot being in communication with said duct.

* * * * *